US007510153B2

(12) United States Patent
Hendricks

(10) Patent No.: US 7,510,153 B2
(45) Date of Patent: Mar. 31, 2009

(54) SINGLE PIECE MOUNTING FRAME

(75) Inventor: Robert Hendricks, Youngstown, OH (US)

(73) Assignee: Tapco International Corporation, Wixom, MI (US)

( * ) Notice: Subject to any disclaimer, the term of this patent is extended or adjusted under 35 U.S.C. 154(b) by 882 days.

(21) Appl. No.: 10/435,258

(22) Filed: May 9, 2003

(65) Prior Publication Data

US 2004/0221522 A1 Nov. 11, 2004

(51) Int. Cl.
*E04C 1/39* (2006.01)
*E04C 1/00* (2006.01)

(52) U.S. Cl. ..... 248/231.9; 248/222.41; 248/224.8; 52/198; 52/220.8

(58) Field of Classification Search ..... 52/211, 52/199, 198, 220.1, 447, 27, 220.8; 248/56, 248/57, 544, 225.11, 222.12, 224.8, 222.41, 248/231.9; 174/58, 54, 61, 63; 220/3.2, 220/3.3; 292/DIG. 11, DIG. 53, DIG. 54; 467/544, 136; 24/517, 487, 489; 269/43; 439/544, 136

See application file for complete search history.

(56) References Cited

U.S. PATENT DOCUMENTS

| | | | | | |
|---|---|---|---|---|---|
| 1,386,424 | A | * | 8/1921 | Reiter | 24/485 |
| 1,484,001 | A | | 2/1924 | Ainsworth | |
| 1,490,252 | A | * | 4/1924 | Bissell | 220/3.6 |
| 2,133,883 | A | * | 10/1938 | Aubert | 280/814 |
| 2,167,419 | A | * | 7/1939 | Heanes | 361/659 |
| 2,456,450 | A | * | 12/1948 | Sauter | 248/27.1 |
| 2,494,428 | A | | 1/1950 | Buck | 173/332 |
| 2,648,516 | A | * | 8/1953 | Manetti et al. | 248/311.2 |
| 2,752,844 | A | | 7/1956 | Simblest | 98/121 |
| 2,780,128 | A | | 2/1957 | Rapata | 85/5 |
| 2,927,497 | A | | 3/1960 | Rapata | 85/5 |
| 2,954,957 | A | * | 10/1960 | De Witt et al. | 248/584 |
| 3,103,710 | A | | 9/1963 | Fredricksen | 20/11 |
| 3,139,784 | A | | 7/1964 | Moorman | 85/5 |
| 3,315,924 | A | | 4/1967 | Greenwood | 248/27 |
| 3,455,079 | A | | 7/1969 | Frederick | 52/473 |
| 3,494,244 | A | | 2/1970 | Wayland | 85/5 |
| 3,500,600 | A | | 3/1970 | Bagley, Sr. | 52/211 |
| 3,575,372 | A | * | 4/1971 | Emberson | 248/501 |
| 3,584,427 | A | | 6/1971 | Johnston | 52/473 |
| 3,597,526 | A | * | 8/1971 | Boatwright et al. | 174/56 |
| 3,810,279 | A | | 5/1974 | Swick et al. | 24/73 P |
| 3,871,723 | A | * | 3/1975 | Pray | 384/495 |
| D245,554 | S | * | 8/1977 | Surkin et al. | D6/552 |

(Continued)

FOREIGN PATENT DOCUMENTS

| | | |
|---|---|---|
| CH | 568497 | 8/1977 |

(Continued)

*Primary Examiner*—Phi Dieu Tran A
(74) *Attorney, Agent, or Firm*—Howard & Howard Attorneys PLLC

(57) ABSTRACT

A wall-mounting frame is used to mount fixtures to building walls having siding. The wall-mounting frame includes two major parts, a base section and a holding section which are non-detachably connected to each other. The holding section is separated into two halves which pivot about the base section to hold surrounding siding to the base section once it has been attached to a wall substrate. The present design eliminates the need for special hardware to attach the holding section to the base section, and helps prevent awkward mounting situations.

14 Claims, 3 Drawing Sheets

U.S. PATENT DOCUMENTS 4,057,983 A * 11/1977 Morgan ..... 70/18
4,156,272 A 5/1979 Wandler ..... 362/432
4,245,284 A 1/1981 Moore et al. ..... 362/311
4,287,657 A 9/1981 Andre et al. ..... 29/450
4,336,416 A * 6/1982 Goodsell ..... 174/48
4,389,824 A 6/1983 Anderson ..... 52/211
4,407,100 A 10/1983 Huelsekopf ..... 52/212
4,445,622 A * 5/1984 Sideri ..... 220/3.6
4,472,768 A 9/1984 Quiogue ..... 362/370
4,635,168 A 1/1987 Crowley ..... 562/147
4,726,152 A 2/1988 Vagedes et al. ..... 52/28
4,875,318 A * 10/1989 MacLeod et al. ..... 52/211
4,920,708 A 5/1990 MacLeod et al. ..... 52/60
4,922,673 A * 5/1990 Ishii et al. ..... 52/220.1
5,000,409 A 3/1991 MacLeod et al. ..... 248/205.1
5,221,069 A * 6/1993 Struthers et al. ..... 248/231.9
5,326,060 A * 7/1994 Chubb et al. ..... 248/231.9
5,349,799 A 9/1994 Schiedegger et al. ..... 52/473
5,370,345 A * 12/1994 Condon ..... 248/65
5,374,017 A * 12/1994 Martin et al. ..... 248/56
5,397,093 A * 3/1995 Chubb et al. ..... 248/544
5,471,803 A 12/1995 Logan et al. ..... 52/212
5,487,701 A 1/1996 Schedegger et al. ..... 454/271
5,577,702 A * 11/1996 Chubb et al. ..... 248/544
5,596,852 A 1/1997 Schiedegger ..... 52/212
5,722,208 A * 3/1998 Humphrey et al. ..... 52/220.8
5,729,935 A 3/1998 Schiedegger et al. ..... 52/198
5,755,069 A 5/1998 Sullivan ..... 52/473
5,791,985 A 8/1998 Schiedegger et al. ..... 454/339
5,871,374 A * 2/1999 Maney ..... 439/596
5,918,431 A * 7/1999 Schiedegger et al. ..... 52/220.1
5,987,836 A 11/1999 Sullivan ..... 52/473
6,112,927 A * 9/2000 Gretz ..... 220/3.7
6,196,915 B1 3/2001 Schiedegger et al. ..... 454/339
6,359,220 B2 * 3/2002 Schiedegger et al. ..... 174/50
6,383,072 B2 5/2002 Schiedegger et al. ..... 454/339
6,386,972 B1 5/2002 Schiedegger et al. ..... 454/358
6,417,447 B1 * 7/2002 Bosse, Jr. ..... 174/505
6,429,371 B2 * 8/2002 Schiedegger et al. ..... 174/50
6,604,333 B1 8/2003 Schiedegger et al. ..... 52/456
6,723,921 B2 * 4/2004 Vagedes ..... 174/58
6,769,562 B2 * 8/2004 Schroeder ..... 220/3.5
6,825,414 B2 * 11/2004 Vagedes ..... 174/58
6,929,142 B2 * 8/2005 Gilbert et al. ..... 220/216
7,115,820 B1 * 10/2006 Gretz ..... 174/481
7,148,421 B2 * 12/2006 Nagashima et al. ..... 174/67

FOREIGN PATENT DOCUMENTS

DE 2406231 8/1974
FR 2 334 869 7/1977
FR 2695532 * 4/1992 ..... 174/58
FR 2695532 * 3/1994 ..... 174/58
GB 2065988 * 7/1981 ..... 174/58
GB 2 149 494 A 6/1985
GB 2149494 A 6/1985
GB 2211364 * 6/1989 ..... 174/61
JP 54-70670 * 6/1979 ..... 248/225.11
JP 6-225430 * 8/1994 ..... 174/58

* cited by examiner

1

SINGLE PIECE MOUNTING FRAME

FIELD OF THE INVENTION

The present invention is generally related to frames or brackets for mounting fixtures to a wall. More particularly, the present invention is directed to the wall-mounting frame that is easily used to lock over the siding of a wall on which the frame is used.

BACKGROUND ART

Standard frame construction is used in virtually all residential and related construction in the United States, and many other places throughout the world. This method of construction includes a wooden or steel framework of studs covered with a light sheathing of foam, light fiberboard or plywood, Celotex™, or any number of other light sheathing or substrate materials. Normally, heavy-duty fiberboard or plywood is not used throughout a frame construction due to the cost. Further, it has been found far more desirable to use a sheathing material that has some insulating or even waterproof value. Normally, some type of siding material is applied over the sheathing to provide water resistance and decorative features.

Sometimes the sheathing is of wood, and has substantial structural value. In other cases, the sheathing can be low-gauge vinyl supported by a foam backing to obtain improved insulating properties, but having little structural value. The same types of materials can also be used for the overlying siding. In many cases, neither the siding nor the underlying sheathing is separately capable of supporting a fixture to be mounted on the wall. Consequently, standard frame construction very often requires that both the sheathing and the siding be used in conjunction to support any fixtures to be added to the wall. Otherwise the fixture must be moved so as to be supported by a stud.

As a result, the building industry has developed a number of mounting frames that utilize the combined strength of the siding and the underlying substrate or sheathing. This is done by having a lower mounting frame attached around an aperture to the sheathing at as many points as feasible. Preferably, one of these points will be at a supporting stud, or a piece of sheathing that is constituted by heavy-gauge plywood or fiberboard, as is used at the corner of many structures. A second mounting frame piece is attached to the lower mounting frame on the sheathing. Normally this second piece is used to constitute the support for the external fixture, and is firmly connected to the sidewalls extending from the frame on the sheathing. The second mounting frame piece derives a great deal of its strength by firmly interfacing with the perpendicular framework of the lower mounting frame. Finally, there is a holding piece (or pieces) which attaches either to the fixture support or the lower mounting frame (in some cases both) to utilize the structural capability of the siding around the overall mounting frame.

By placing a solid framework around the aperture in the wall, and firmly interlocking all three of the mounting frame pieces, a moderately stable mounting support for a fixture can be effected even on a relatively flimsy wall. The key has often been to completely frame the aperture and reinforce the framework using all parts of the wall structure. However, using conventional mounting frames, this process has not always been easy to carry out. In many traditional arrangements, three different pieces must be fit together, in addition to mounting the fixture on one part of the wall-mounting frame. Consequently, the process could be extremely awkward, especially if unskilled labor is employed.

Another problem, even for highly skilled workers, is the fact that the conventional mounting frames normally come in three separate pieces, often with separate connecting devices for each piece. Under the often-chaotic conditions of construction sites, pieces of the mounting frames, especially the connectors, can be misplaced or lost. This results in delays or other difficulties, and often leads to the expedient of ordering redundant mounting frames just to make certain that a full kit is available when needed.

This problem has been addressed in part by arrangements in which two of the three components are attached together. However, there have been difficulties with such arrangements since sometimes the attached components must be separated for one to be mounted, and then reattached to the other. This leads to the same problems previously described.

In some cases, two of the components are permanently mounted together, alleviating some of the aforementioned difficulties. However, the upper holding piece which is used to hold the entire mounting frame tight to the surrounding siding, is always a separate piece in conventional mount frame designs. Otherwise, it would be impossible to position and connect the mounting bracket to the wall using conventional mounting frames. In many cases, this upper holding piece can be lost. In some cases, even if the upper holding piece is not lost, its connectors can be, thereby compromising the overall mounting frame.

Accordingly, there is a substantial need for an improved wall-mounting frame that overcomes the difficulties of the conventional mounting frames. In particular, such an improved mounting frame would alleviate the problems of lost parts, and facilitate easy mounting. Also, an improved mounting frame would provide for varying thicknesses of siding and sheathing.

SUMMARY OF THE INVENTION

Accordingly, it is one object of the present invention to overcome the deficiencies of the conventional art.

It is another object of the present invention to simplify the installation of fixtures on wood frame walls, and other structures in which an aperture is used with the fixture.

It is a further object of the present invention to provide a wall-mounting frame that is specific for a single siding thickness.

It is an additional object of the present invention to provide a wall-mounting frame which is configured to avoid the loss of critical parts.

It is still another object of the present invention to provide a wall-mounting frame that is more easily installed than conventional mounting frames.

It is yet a further object of the present invention to provide a wall-mounting frame that has the capability of utilizing all structural aspects of a wall to maintain a secure support for a fixture.

It is again an additional object of the present invention to provide a wall-mounting frame having integral parts to facilitate handling of the frame during the mounting process.

It is still another object of the present invention to provide a wall-mounting frame that is formed to be extremely robust.

It is again a further object of the present invention to provide a mounting frame for wall vents and gable vents of varying sizes and shapes.

It is yet an additional object of the present invention to provide a mounting frame for a wide variety of fixture types.

These and other goals of the present invention are accomplished by a wall-mounting frame having a single integral body arranged to hold a fixture to a wall having a substrate and siding arranged over the substrate. The wall-mounting frame includes a base section having at least one mounting flange arranged against the substrate and a support structure extending perpendicularly from the mounting flange. The support structure has a mounting surface arranged approximately parallel to the substrate and is configured to receive the fixture to be mounted. Also included is a non-detachable holding section permanently connected to the base section by a pivot structure. The holding section is configured to rotate in two halves around the base structure.

DETAILED DESCRIPTION OF THE PREFERRED EMBODIMENTS

Figure 1:
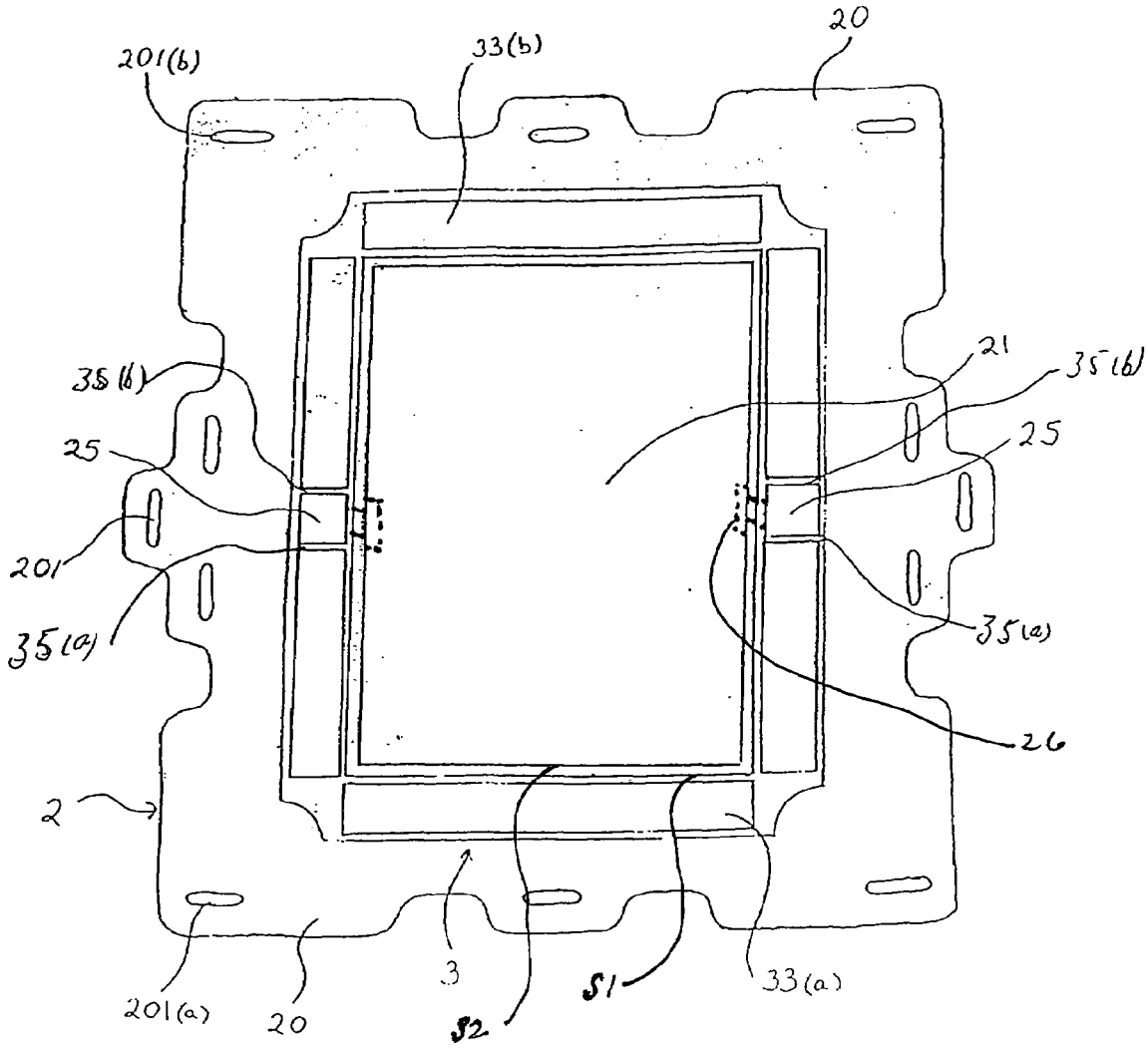
FIG. 1 is a top view of the wall-mounting frame of the present invention.
Figure 2:
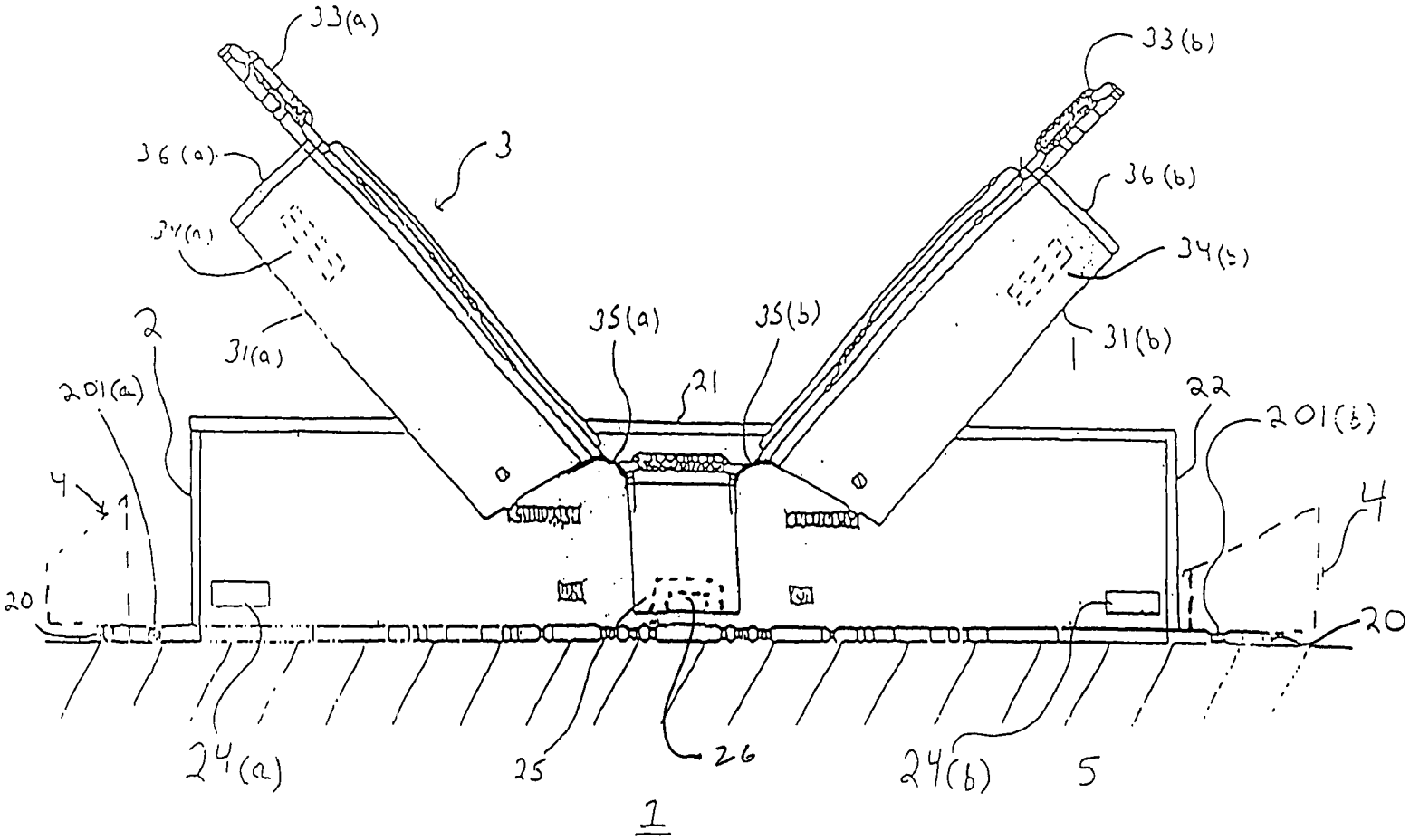
FIG. 2 is a side view of the wall-mounting frame with the holding section in a locked or permanent position.
Figure 3:
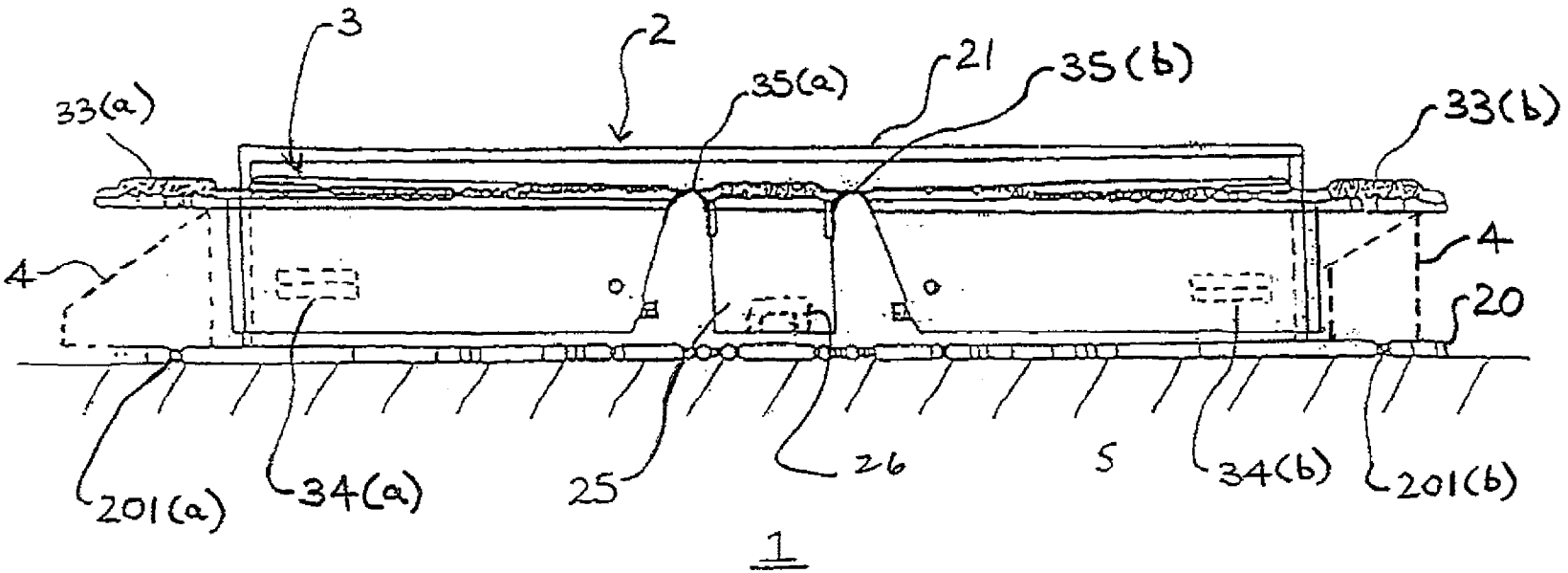
FIG. 3 is a side view of the wall-mounting frame with the holding section positioned for handling of the wall-mounting frame before final installation.

The wall-mounting frame 1 of the present invention is depicted in FIGS. 1-3, which all use the same drawing designation numerals for the various parts of the wall-mounting frame. The wall-mounting frame of the present invention is meant in a first preferred embodiment to be mounted around an aperture in a wooden frame wall of standard construction. However, the aperture is not necessary for the proper operation of the present invention.

The strength of the wall-mounting frame 1 of the present invention allows it to be particularly effective even in walls constituted by flimsy materials. However, the present invention facilitates use with an aperture in almost any type of structural material. This can include anything from plastic to steel. Preferably the wall structure will have some sort of siding to help facilitate the locking of the mounting frame to the wall, thereby making use of all the benefits of the present invention.

In all of its embodiments, the present invention is made of a single integral piece, with non-detachable moving parts permanently connected thereto. This can be done by injection or spin molding to form one unitary piece. In the alternative separate pieces can be molded. Even in those cases where manufacturing takes place to form a separate base section 2 and a separate holding section 3 (with a gap between surfaces S1 and S2 of base 2 and section 3), the two are non-detachably connected (for example, by plastic welding or the use of the connecting structures 26 depicted in the drawings), and shipped as a single piece.

In all embodiments of the present invention, the use of a single-piece, integral wall-mounting frame provides many of the benefits of the present invention. In particular, crucial parts cannot be lost since they are non-detachably connected together. This is a critical feature since at most construction sites, chaotic conditions ensue, and it is very common for parts from a box to become separated.

The wall mounting frame 1 of the present invention is best described with reference to FIG. 2. In this depiction, the wall-mounting frame on is in a pre-locking or installation position as it would be configured before being attached to wall substrate 5 and before holding section 3 it would be locked down over siding 4 (which itself is permanently connected to wall substrate 5). It should be noted that the mounting flanges 20, which are part of base section 2, are meant to slide under siding 4 as part of the overall installation. It should be understood that pieces of siding 4 must be removed to accommodate mounting frame 1 which is meant to fit over an aperture (not shown) in the wall substrate 5. It is noted that wall substrate 5 is usually standard building sheathing, that can be constituted by a number of different materials. The siding 4 is likewise standard material, usually, wood, vinyl, or aluminum. However, other materials can be used for the sheathing or siding with the present invention.

The base section 2 has a mounting surface 21, which is used to hold a fixture (not shown), which has parts (not shown) passing through the wall substrate 5. The entire wall-mounting frame 1 is meant to fit around the interior of an aperture in both siding 4 and substrate 5. Mounting surface 21 can be provided with a number of different holes or drilling arrangements (not shown) to facilitate easy mounting of the fixture (not shown). Mounting surface 21 is supported by support structure 22, having four sidewalls extending around the base section 2. In the preferred embodiment, the sidewall structure 22 is of a single height. However, this is not always the case. Rather, the sidewall structure 22 can be of a telescoping structure to accommodate different sizes of siding 4 or different requirement of the fixtures (not shown) to be mounted on mounting surface 21. Even with such an arrangement, holding section 3 is permanently attached to the base section 2.

On the base section 2, mounting flanges 20 are slipped beneath siding pieces 4, as depicted in the drawings. Mounting holes 201(*a*) and 201(*b*), as well as other mounting holes 201 located along the periphery of the mounting flange 20 can be used to fasten the mounting frame 1 to wall substrate 5. Such fastening can be done by means of wood screws, nails, brads or staples. If wall substrate 5 is metallic, appropriate means can be used for attaching the plastic mounting flange 20 to the metallic skin of wall substrate 5. Most likely sheet metal screws, or even rivets would facilitate the mounting.

It should be understood that the thickness of mounting flange 20 is not limited to any specific value. Rather, this can be made thicker or thinner in the manufacturing process to facilitate connection to a particular type of wall substrate 5. Also, the other parts of the wall-mounting frame 1 can be modified to any size that is appropriate for a particular setting or application. The wall-mounting frame is preferably made of plastic using an injection-molding process, but other processes can be used. Likewise, any number of different materials can be used, including: nylon, rubber, wood or metal.

A crucial aspect of the present invention is the permanent connection of the non-detachable holding section 3 to the base section 2. The two halves 33(*a*) and 33(*b*) of non-detachable mounting section 3 are attached to the base section 2 by way of permanently connected mounting blocks 25 (including connecting structures 26, such as welds), which constitutes a part of the pivoting structure that allows the two halves to rotate in and out of position. The two mounting blocks 25, as depicted in FIG. 1, provide the hinge structures 35(*a*) and 35(*b*) on both sides of the base section 2. Usually, mounting block 25 is welded to, attached with connecting structures 26, or otherwise formed as a permanent part of base section 2 before wall-mounting frame 1 is shipped from the factory to a job site. This arrangement prevents the base section and the holding section from becoming detached from each other, a common occurrence at chaotic construction sites. This arrangement also eliminates the need for special hardware to hold the mounting frame to the holding section.

The twin hinge structures 35(*a*), 35(*b*) allow the two halves 31(*a*), 31(*b*) to rotate down and around the sidewalls 22 of base section 2 by way of a gap formed between surfaces S1 and S2 of base section 2 and pivoting halves 31(*a*), 31(*b*). When this is done, upper flanges 33(*a*), 33(*b*) fit securely over portions of the siding pieces 4. This helps hold the mounting frame 1 securely to the wall, securing to siding. Likewise, mounting frame secures cut portions of the siding 4 more closely to the wall substrate 5, compensating for the fact that part of the siding and its attachments to the substrate might have been removed or otherwise compromised. FIG. 3 depicts the wall-mounting frame 1 in its final mounted position on wall substrate 5.

The pieces of siding 4 are securely held in an arrangement that includes the mounting frame 1, the wall-substrate 5 and the siding 4. FIG. 3 depicts the mounting surface 21 as extending above the upper flanges 33(*a*), 33(*b*). However, the mounting surface 21 could be recessed beneath the upper flanges, or could project even further above the upper flanges than is depicted in FIG. 3.

The pivoting arrangement relying upon hinges 35(*a*), 35(*b*) on each side of the mounting block are formed as a single unitary piece with two halves 31(*a*), 31(*b*) of non-detachable holding section 3 and mounting block 25. The hinge normally need be rotated through no more than a 45° arc, thereby saving considerable wear and possible failure of the flexible plastic structure of the hinge. The fact that the hinges are formed as part of both the block and the two halves of the base section allows a thin, flexible structure to be used without substantial change of failure. It should be noted that the hinges need not be designed for a substantial number of use cycles since they flex only when the non-detachable holding section 3 is being used to handle the mounting frame 1 as it is being conveyed or mounted.

While the holding section 3 is non-detachable from base section 2, the same is not true with respect to the overall wall-mounting frame 1 and wall substrate 5. It is possible for the nails- or screws through mounting holes 201(*a*), 201(*b*) to be removed and for the flexible mounting flanges 20 to be slid from beneath siding 4. Likewise, the two halves 31(*a*), 31(*b*) can be rotated up from the position depicted in FIG. 3 to the position depicted in FIG. 2. By first rotating the two halves of the non-detachable holding section 3 and then removing the fasteners holding the mounting flange to wall-substrate 5, it is possible to remove mounting frame 5 and the fixture (not shown), which is mounted on mounting surface 21.

Locking teeth 34(*a*), 34(*b*) on each side of the two halves 31(*a*), 31(*b*) are provided so that both halves of the holding section 3 can be held tightly to the sidewalls 22 of the base section. The locking mechanism depicted as 34(*a*), 34(*b*) is constituted by at least one tooth pointed inwards towards the base section 2. These teeth interface with locking indents 24(*a*), 24(*b*), on each side of the base section so that the two halves are held firmly in place.

Multiple locking apertures 24(*a*), 24(*b*) can be placed at various vertical positions along the sidewalls 22 of the base section. This will facilitate the locking of the two pivoting halves 31(*a*), 31(*b*) at various positions in order to accommodate different thicknesses of siding while still maintaining the advantages of the present invention. However, this may not be the optimum method for making large adjustments to adapt the present invention to various siding sizes. In another alternative, the hinges 35(*a*), 35(*b*) can be permanently mounted in slots using a variety of attaching structures 26 that will allow the entirety of the two halves 31(*a*), 31(*b*) to be moved vertically on side walls 22 of the base section 2. As with all the other embodiments of the present invention, the two halves cannot be disconnected from the base section. This was generally considered superior to another alternative embodiment in which the side walls telescope within each other while supporting the hinge structures.

It should be understood that the positioning of the two halves 31(*a*), 31(*b*) of the non-detachable holding section 3 can be altered as part of the manufacturing process by increasing the height of sidewalls 22 of the base section 2 and relocating the vertical position of the mounting block 25 by using various types of attaching structures 26. However, it should be understood that once the mounting block 25 has been attached to the base section 2 (as part of the manufacturing process), the mounting block can no longer be adjusted since it is not removable. Also, while the simple tooth and aperture arrangement are depicted in FIG. 2, locking devices that can be used are not limited thereto. Rather any mechanism that can be used to hold the two halves of the non-detachable holding section 3 to the base unit section 2 is appropriate.

While the double hinge arrangement 35(*a*), 35(*b*) is used with mounting block 25, this is not the only method that can be used to hinge the two pivoting halves 31(*a*), 31(*b*) of the non-detachable holding section 3. For example, only a single pin or pivot on each side of the two halves of the holding section might be used to hold the holding section to the base section 2. The sidewalls 36(*a*), 36(*b*) would have to be arranged to slide over each other as the two halves rotated around two common pivot pins. This is a much more awkward arrangement than that depicted in the drawings, but can still be used within the basic concept of the present invention. All that matters is that the holding section 3 not be detachable from base section 2. Other pivot structures can also be used. The pivot structure can be a non-removable metallic pin, or plastic structure. The sidewalls, 36(*a*), 36(*b*) can be configured as necessary so that the pivoting can be done in the most expeditious manner.

While the examples depicted in the drawings have been square in shape with a mounting surface and the possibility of a drilling pattern, the present invention is not limited to this configuration. Rather, the shape of the mounting frame can be circular, half-circular, trapezoidal, or even triangular. Further, rather than providing simply a mounting surface for a fixture, the entire mounting frame can encompass the fixture. Examples would be gable vents and dryer exhaust vents. The use of the present invention in such an embodiment would greatly simplify the mounting of gable vents, which can be somewhat problematic using conventional methods. A wide range of fixtures can be accommodated with the present invention. Accordingly, the present invention can be used with plumbing fixtures, such as wall-mounted valves or faucets, as well as lights, vents, decorative fixtures, and the like.

A number of the embodiments of the present invention have been made by way of example, present invention is not limited thereby. Rather, the present invention should be construed to include any and all modifications, variations, permutations, adaptations, derivations and embodiments that would occur to one skilled in this art and comprehending the teachings of the present invention. Accordingly, the present invention should be limited only by the following claims.

I claim:

1. A wall-mounting frame for supporting a fixture to an external wall constituted by a substrate and siding attached over said substrate, said wall mounting frame having a molded body arranged to hold and support an external fixture to said external wall, said wall-mounting-frame comprising:

a. a base section integrally formed as a single piece and having at least one mounting flange arranged to be positioned against and attached to said substrate with connectors, and a continuous vertical support wall extending perpendicularly upwards from said mounting flange to form an enclosure having as its top a single integral upper mounting surface perpendicular to said vertical support wall providing a sole support for said fixture; and b. a holding section in two halves comprising vertical walls and horizontal flanges, and connected to said vertical support walls of said base section by pivot structures, wherein each said pivot structure comprises a mounting block connected to said vertical support wall each of said halves having two end portions pivotally connected to said pivot structures, said two halves arranged to rotate around said vertical support walls of said base section and over said siding to hold said siding.

2. The wall-mounting frame of claim 1, wherein said single integral mounting surface is substantially parallel to said substrate.

3. The wall-mounting frame of claim 2, wherein said wall-mounting frame comprises plastic.

4. The wall-mounting frame of claim 1, wherein the wall-mounting frame is made of material selected from a group consisting of rubber, metal, nylon, and wood.

5. The wall-mounting frame of claim 2, wherein each hinges on either side of said pivot structure permanently connected to said halves of said holding section.

6. The wall-mounting frame of claim 2, wherein said pivot structures are formed of metal.

7. The wall-mounting frame of claim 5, wherein said holding section comprises a pair of upper flanges rotatable to lock over said siding.

8. The wall-mounting frame of claim 7, wherein said holding section comprises side walls extending perpendicular to said upper flanges, and arranged to surround said base section.

9. The wall-mounting frame of claim 8, wherein said upper flange is arranged to flex at said hinges as said two halves fold towards each other.

10. The wall-mounting frame of claim 9, further compromising locking means for holding each of said halves against said siding.

11. The wall-mounting frame of claim 10, wherein said locking means comprise an indent on said vertical support wall and a complementary projection on said side wall of said holding section.

12. The wall-mounting frame of claim 11, wherein said locking means comprise four rectangular indents on said vertical support wall and four complementary triangular projections arranged on said halves.

13. The wall-mounting frame of claim 12, wherein said mounting flange extends entirely around said vertical support wall.

14. The wall-mounting frame of claim 1, wherein said wall mounting frame is adapted to encompass and support a gable vent.

* * * * *

UNITED STATES PATENT AND TRADEMARK OFFICE

CERTIFICATE OF CORRECTION

PATENT NO. : 7,510,153 B2
APPLICATION NO. : 10/435258
DATED : March 31, 2009
INVENTOR(S) : Robert Hendricks It is certified that error appears in the above-identified patent and that said Letters Patent is hereby corrected as shown below:

In Column 6, line 63, please delete "wall-mounting-frame" and replace with -- wall-mounting frame --

In Column 7, line 10, please delete "support wall each" and replace with -- support wall, each --

In Column 7, line 24, please delete "wherein each" and replace with -- further comprising --

In Column 8, from line 11 to line 12, please delete "further compromising" and replace with -- further comprising --

Signed and Sealed this

Nineteenth Day of May, 2009

JOHN DOLL
*Acting Director of the United States Patent and Trademark Office*